US011731166B2

(12) United States Patent
Larsson

(10) Patent No.: US 11,731,166 B2
(45) Date of Patent: Aug. 22, 2023

(54) DETECTION SYSTEM

(71) Applicant: METSO SWEDEN AB, Trelleborg (SE)

(72) Inventor: Claes Larsson, Bjärred (SE)

(73) Assignee: Metso Sweden AB, Trelleborg (SE)

( * ) Notice: Subject to any disclaimer, the term of this patent is extended or adjusted under 35 U.S.C. 154(b) by 0 days.

(21) Appl. No.: 17/544,205

(22) Filed: Dec. 7, 2021

(65) Prior Publication Data

US 2022/0088640 A1 Mar. 24, 2022

Related U.S. Application Data

(63) Continuation of application No. 16/345,322, filed as application No. PCT/EP2017/077656 on Oct. 27, 2017, now Pat. No. 11,224,897.

(30) Foreign Application Priority Data

Oct. 28, 2016 (SE) ..... 16196333-5

(51) Int. Cl.
*B07B 1/42* (2006.01)
*B06B 1/16* (2006.01)
(Continued)

(52) U.S. Cl.
CPC ..... *B07B 1/42* (2013.01); *B06B 1/16* (2013.01); *B07C 1/00* (2013.01); *B07C 5/34* (2013.01); *B07C 5/36* (2013.01)

(58) Field of Classification Search
CPC .... B07C 5/34; B07C 5/36; B07C 1/00; B07B 1/42; B06B 1/16
(Continued)

(56) References Cited

U.S. PATENT DOCUMENTS 3,722,676 A 3/1973 Mathews
7,665,614 B2 2/2010 Malmberg
(Continued)

FOREIGN PATENT DOCUMENTS

CA 2 412 617 A1 5/2004
CA 2412617 A1 * 5/2004 ..... B07C 5/02
(Continued)

OTHER PUBLICATIONS

International Search Report and Written Opinion for International Patent Application No. PCT/EP2017/077656 dated Jan. 19, 2018.
(Continued)

*Primary Examiner* — Terrell H Matthews
(74) *Attorney, Agent, or Firm* — Andrus Intellectual Property Law, LLP

(57) ABSTRACT

The invention relates to a detection system in a screening device for screening material, e.g. aggregate, ore or similar, comprising at least one screening decks, the at least one screening deck having a screening surface comprising one or more screening modules. The system comprises a sensor arranged at or near at least one screening deck of the screening device. The sensor is arranged such that it can detect objects present leaving the at least one screening deck. The invention also relates to a method for detection of objects in a screening device, and use of the detection system.

22 Claims, 4 Drawing Sheets

(51) Int. Cl.

| | |
|---|---|
| ***B07C 1/00*** | (2006.01) |
| ***B07C 5/34*** | (2006.01) |
| ***B07C 5/36*** | (2006.01) |

(58) Field of Classification Search
USPC ..... 209/599
See application file for complete search history.

(56) References Cited

U.S. PATENT DOCUMENTS

| | | | | |
|---|---|---|---|---|
| 11,224,897 | B2 * | 1/2022 | Larsson | B06B 1/16 |
| 2002/0067259 | A1 | 6/2002 | Fufidio et al. | |
| 2010/0230330 | A1 | 9/2010 | Afsari et al. | |
| 2013/0043168 | A1 | 2/2013 | Dufilho et al. | |
| 2013/0050007 | A1 | 2/2013 | Ammar | |
| 2014/0291213 | A1 * | 10/2014 | Chen | B07C 5/367 209/44.2 |
| 2017/0320095 | A1 * | 11/2017 | Lunnemann | B07B 1/28 |

FOREIGN PATENT DOCUMENTS

| | | | | | |
|---|---|---|---|---|---|
| CL | 201103193 | | | 7/2012 | |
| CL | 201601058 | | | 12/2016 | |
| CN | 103221149 | A | | 7/2013 | |
| CN | 103221149 | A | * | 7/2013 | B01D 33/0315 |
| DE | 24 11 388 | A1 | | 9/1975 | |
| DE | 2411388 | A | * | 9/1975 | B07C 5/3425 |
| DE | 198 37 466 | C1 | | 11/1999 | |
| DE | 19837466 | C1 | * | 11/1999 | B07B 1/288 |
| EP | 0980718 | A2 | * | 6/1999 | |
| EP | 0980718 | A2 | * | 2/2000 | |
| EP | 3315216 | A1 | | 5/2018 | |
| JP | H05277447 | A | | 10/1993 | |
| JP | 2014073469 | A | | 4/2014 | |
| RU | 2432214 | C2 | | 10/2011 | |
| SU | 1701399 | A1 | | 12/1991 | |
| UA | 30568 | U1 | | 10/2008 | |
| WO | WO-2014064336 | A2 | * | 5/2014 | B02C 21/026 |
| WO | 2015200886 | A1 | | 12/2015 | |
| WO | WO-2016085073 | A1 | * | 6/2016 | G01H 11/00 |

OTHER PUBLICATIONS

International Preliminary Report on Patentability for International Patent Application No. PCT/EP2017/077656 dated Feb. 4, 2019.
Search Report for corresponding Chilean Patent Application No. 201901156 dated Feb. 17, 2020.
Office Action for corresponding Chinese Patent Application No. 201780067248.1 dated Aug. 27, 2020.
Decision to Grant and Search Report for corresponding Russian Patent Application No. 2019115246/03 dated Nov. 27, 2020.

* cited by examiner

DETECTION SYSTEM

TECHNICAL FIELD

The invention relates to a detection system and a method for detection of objects in a screening device.

BACKGROUND ART

Modern screening devices used for screening of media normally comprise a screen panel support and screening modules which are arranged in the screen panel support. These screens have several advantages compared with those of earlier generations since individual screening modules can be exchanged when worn out or broken.

The screening modules should have an active surface that is as large as possible and the size of the active surface is normally limited by the rigidity of the screening module. This since a screening module of lower strength requires supporting sections arranged at shorter intervals, which results in an increased amount of dead surface of the screening module. Nevertheless, making the entire screening surface consist of a single screening module and reducing the number of supporting points to a minimum does not constitute a convenient alternative. Such a method would certainly provide a maximum amount of active surface, but at the price of very high operating expenses since it would be necessary to exchange the entire screen deck also in case of local wear.

Consequently, it is desirable to have a screen with a large active surface and high stability, in which it would be easy to exchange individual screening modules.

Since the screens of the type above are subjected to substantial forces during use, the screening modules must be locked in place to the frame to prevent them from becoming loose. A conventional way of achieving this is by using a hammer to knock down a locking element into some sort of a sleeve provided in the screen panel support, or by screwing the screening modules to the screen panel support. A problem with these types of screens is that there is always a risk of the screening modules detaching from the screen panel support during use. When that happens it is vital for the continued operation of the screening device that the detached screening module is detected and replaced as quick as possible. Otherwise, quality of the screened product will become compromised and it is also conceivable that a detached screening element may cause breakdown of the screening device or other apparatuses downstream the screening device. Further, liner elements used in the screening device may also detach and cause problems downstream the screening device. DE-19837466 discloses a detection system in a screening device comprising a sensor for detection of disturbances in the screening device.

SUMMARY OF THE INVENTION

It is an objective of the present invention to provide an improvement of the above technique and prior art. More particularly, it is an objective of this invention to provide an improved detection system and a method for detection of objects in a screening device.

According to a first aspect, these and other objects, and/or advantages that will be apparent from the following description of embodiments, are achieved, in full or at least in part, by a detection system in a screening device for screening material, e.g. aggregate, ore or similar, comprising at least one screening deck, the at least one screening deck having a screening surface comprising one or more screening modules. The system comprises a sensor arranged at or near a discharge of the least one screening deck of the screening device. The sensor is arranged such that it can detect objects present near the discharge of the at least one screening deck. Furthermore, the sensor comprises an ultrasound sensor.

This is advantageous in that the material leaving the screening decks can be monitored so that any foreign object can be detected. Essentially, the detection system will be used to detect if any screening modules, liner elements or similar have become detached from their position in the screening device. Since for example a screening module is made of a different material and typically is larger in size compared to the material that is to be screened in the screening device, it can be detected by the detection system when passing an area covered by the sensors. As soon as a screening module, liner element or similar is detected in the mass flow in the screening device, the screening device can be stopped so that the foreign object can be re-attached or replaced.

The sensor could be placed at a strategic position so that it will cover a pre-defined area near the discharge of the screening deck and preferably not be in direct contact with the screening device to avoid being exposed to the vibrations of the screening device. The sensor may thus be arranged at or near a discharge of the at least one screening deck, or at or near a funnel arranged downstream of the one or more screening decks. In another preferred embodiment, the sensor may be arranged on a support structure independent from the screening device. Naturally, if suitable, the sensor may also be attached to a side wall of the screening device.

Further, the sensor may be arranged to transmit signals in a direction generally perpendicular to a mass flow from the one or more screening decks, or to transmit signals in a direction generally parallel to a mass flow from the one or more screening decks. Even though the first variant is often preferable, the latter is also conceivable so that the placement can be decided upon based on available space and signal strength.

In accordance with one embodiment of the invention, the sensor is arranged to detect objects present outside a predefined area adjacent to a discharge of the at least one screening deck. This pre-defined area may at least in part be defined by a ballistic trajectory. It has been realized that any objects leaving the discharge of the screening deck, be it sorted material such as gravel or mineral ore or a detached screening module, will follow a path which can be defined as a ballistic trajectory. Further, it has been determined that foreign objects, such as screening modules and liner elements, will follow a path that is wider than that of the sorted material or at least, due to their size, protrude from the path of the sorted material. Hence, screening modules and liner elements will at least protrude away from the flow of sorted material, e.g. gravel or ore material. By arranging the sensor, or sensors, such that an area is covered which lies directly outside of such a ballistic trajectory of the screened material, the sensor or sensors will be able to determine that a foreign object, such as a liner element or screening module is present in the mass flow.

In accordance with one embodiment of the invention, the ballistic trajectory has a starting point at or near a discharge end of the at least one screening deck.

In accordance with one embodiment of the invention, the sensor is a rangefinder. A simple rangefinder can be used since the distance to the wall at the opposing side of the sensor is known and can be defined as being X. Thus, if the rangefinder identifies object/s at a distance d<X, this can be taken as an indication that a foreign object is present in the mass flow.

In accordance with one embodiment of the invention, the sensor is an ultrasound sensor. The ultrasound sensor can be for example of a piezoelectric type or in the form of a capacitive transducer. The ultrasound sensor may be a range finder. The use of ultrasound sensors may be advantageous over prior art solutions such as optical sensors or cameras, as it is operable in a wider range of conditions. Specifically, the often dusty and dirty environment within and near the screen may attenuate optical signals to an extent where optical sensors may not provide accurate measurement data. Moreover, ultrasound detectors may provide high accuracy and they are durable and less sensitive to moisture than many alternative sensors types. They are also fairly inexpensive. Another advantage with ultrasound sensors is that they allow for adjusting the sensitivity of the detection system to detect detached screen modules by post processing the ultrasound signals in different ways, for example by applying filters, adjusting sampling rates etc. Thus, a detection system comprising such ultrasound sensors may be more flexible than other detection systems. This may allow for using the same kind of hardware configuration for the detector system on different embodiments of screens (e.g. different sizes, etc.) and/or for different kind of screening material on a specific screen.

In accordance with one embodiment of the invention, the sensor is arranged on a structure which is independent of the screening device. A separate structure can be arranged to prevent all or at least a great part of the vibrations occurring in a screening device which may be detrimental to the longevity and precision of the sensor/s and other parts of the detection system.

In accordance with one embodiment of the invention, the detection system further comprises a control unit which is connected to the sensor, the control unit being arranged to operate the screening device based on information from the sensor. By arranging a control unit in the detection system, it can be achieved that the operation of the screening equipment is adjusted when a foreign object is detected in the mass flow. For example, the screening procedure could be brought to a halt as a response to detection of such foreign object.

In accordance with one embodiment of the invention, the control unit is arranged to differentiate between signals from the sensor resulting from the material to be screened, e.g. rocks, iron ore, aggregate and similar, and signals from the sensor resulting from a foreign object, such as a dislodged screening module or liner element. The determination of a ballistic trajectory for the sorted material may involve a certain amount of uncertainties and in order to avoid overlooking a foreign object, the sensor/s may be arranged such that there is a certain overlap between the measuring range and the area where sorted material passes. Therefore, it is possible that the sensor/s sometimes will detect sorted material and not only foreign objects. Thus, it is preferable that the control unit is capable of differentiating between sorted material and foreign objects.

In accordance with one embodiment of the invention, the control unit is arranged to differentiate between signals from the sensor resulting from the material to be screened and signals from the sensor resulting from a foreign object, such as a dislodged screening module or liner element, by applying one or more predefined threshold values. The control unit may be a programmable logic controller (PLC), which typically may be described as an industrial digital computer which has been ruggedized and adapted for the control of manufacturing processes. The PLC and/or the sensor(s) may be powered by an external power source. Such an external power source may be for example a battery or a solar cell based system but may also be an electric grid. Measurement data may be transferred via Ethernet cable, for example using the MODBUS protocol.

In accordance with one embodiment of the invention, a threshold value is based on the time an object is present in the range of the sensor. Since a liner element or a screening module normally will be of greater size and made from different materials than the sorted material, it will be present in the range of the sensor/s for a longer time, or at least under a different length of time than particles of the sorted material. Therefore, it is possible to base threshold values on the time an object is present in the range of the sensor/s. The control unit may also, for example, be programmed to have different threshold values which thereafter may be used to determine whether a foreign object exists in the mass flow or not. The threshold levels may also or alternatively be based on the size or on the material of which the detected objects are made from. In other words, the control unit may be arranged to differentiate between signals from the sensor resulting from the material to be screened and signals from the sensor resulting from a foreign object, such as a dislodged screening module or liner element, by applying predefined threshold values. Different materials will reflect acoustic waves differently and objects of different size will also reflect acoustic waves differently. Hence, it is possible to differentiate between e.g. a screening module made from e.g. rubber covered metal and gravel particles to be screened. Some or all of the sensors according to the invention are capable of determining the area of the object which is measured and since e.g. a screening module in most cases will have a larger surface than the particles of the material to be screened, it will be possible to determine presence of a foreign object based on the area of the object that is detected by the sensor/s. These threshold values can be used alone or in combination with one or more of the others.

According to a second aspect, these and other objects are achieved, in full or at least in part, by a method for detection of objects in a screening device comprising one or more screening decks. The method comprises transmitting signals from a sensor in relation to a mass flow from the one or more screening decks, said sensor being arranged such that it can detect objects leaving said at least one screening deck.

In accordance with one embodiment of the invention, the method further comprises the steps of

- defining an area adjacent to a discharge of the at least one screening decks within which it can be presumed that a mass flow of the screened material will be found after leaving said at least one screening deck;
- arranging said sensor such that it can detect any objects outside of said area;
- defining threshold values;
- determining whether or not a foreign object is present in said mass flow by applying said threshold values.

In accordance with one embodiment of the invention, the method further comprises the steps of

- providing a control unit arranged to receive signals from the sensor and;
- determining whether or not a foreign object, such as a dislodged screening module or liner element, is present in the mass flow based on a comparison of signals received by said control unit from said sensor with said threshold values.

In accordance with one embodiment of the invention, the method further comprises the step of controlling an operation parameter of the screening device based on an outcome of said comparison of signals received by said control unit from said sensor with said threshold values.

According to a third aspect, these and other objects are achieved, in full or at least in part, by a use of a detection system according to the features described above, in a screening device comprising one or more screening decks, in order to detect objects present on or near the one or more screening decks.

Effects and features of the second and third aspect of the present invention are largely analogous to those described above in connection with the first aspect of the inventive concept. Embodiments mentioned in relation to the first aspect of the present invention are largely compatible with the second and third aspect of the invention.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

As used herein, the term "comprising" and variations of that term are not intended to exclude other additives, components, integers or steps.

BRIEF DESCRIPTION OF THE DRAWINGS

The above, as well as additional objects, features and advantages of the present invention, will be better understood through the following illustrative and non-limiting detailed description of embodiments of the present invention, with reference to the appended drawings, where the same reference numerals may be used for similar elements, and wherein.

DETAILED DESCRIPTION OF PREFERRED EMBODIMENTS OF THE INVENTION

Figure 1A:
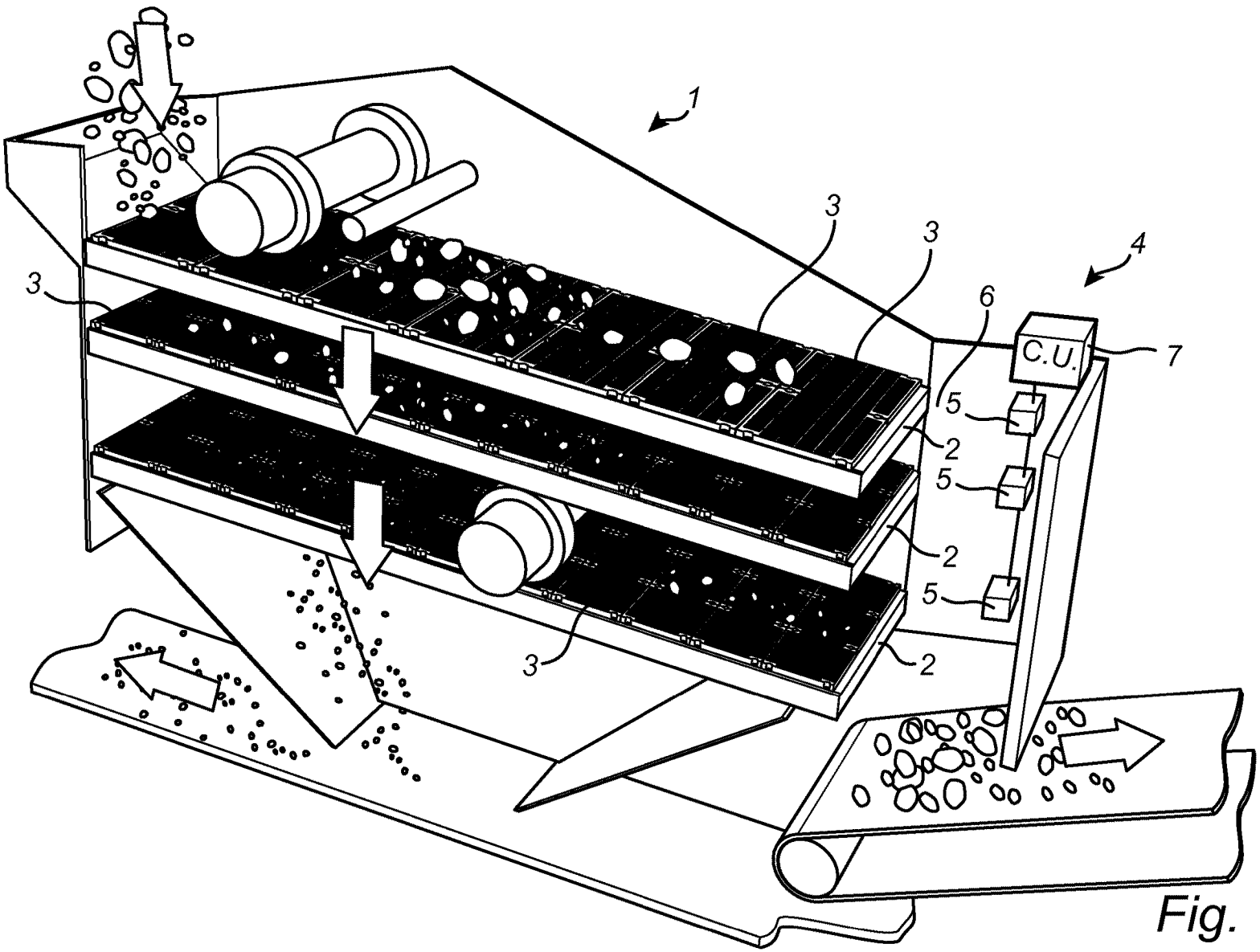
FIGS. 1*a* and 1*b* are perspective views of a screening device equipped with a detection system according to one exemplary embodiment of the invention.
Figure 1B:
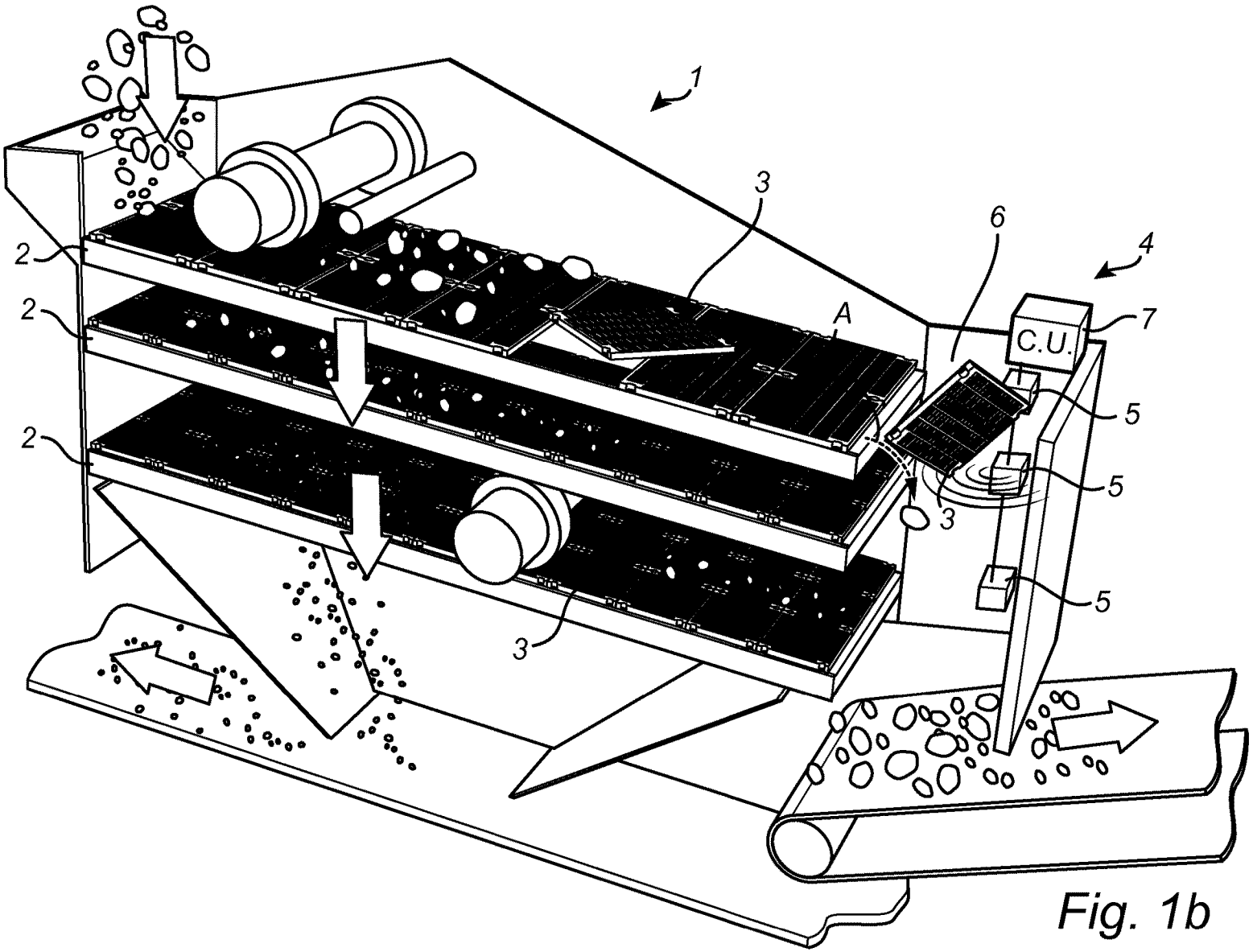
Figure 4:
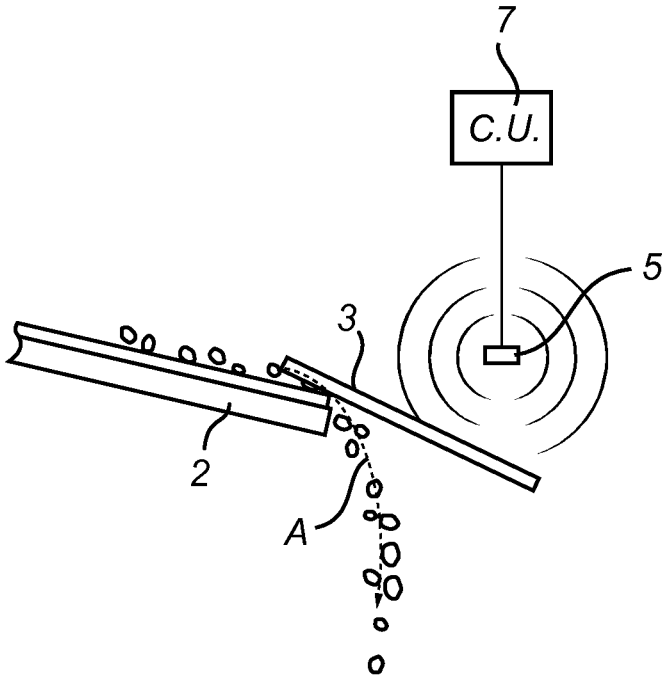
FIG. 4 is an enlarged side view of a part of a screening device equipped with a detection system according to one exemplary embodiment of the invention.

FIGS. 1*a*, 1*b* and 4 illustrate a screening device 1 comprising three screening decks 2, each of which consists of a plurality of screening modules 3. Each screening module 3 has one apertured section. The apertured section has a first, upper surface intended to receive and carry material to be screened, a second, lower surface opposite the first surface, and a circumferential surface. The apertures extend from the first surface to the second surface. The screening device 1 is equipped with a detection system 4 which here comprises three sensors 5. The sensors 5, which, according to the example embodiment, are rangefinders of ultrasound type, are arranged such that they can detect objects present near a discharge 6 of the respective screening deck 2. In this embodiment (see also FIG. 2), each sensor 5 is attached to a side wall arranged downstream of the screening decks 2. The sensors 5 are connected to a control unit 7 and arranged to transmit signals in a direction generally perpendicular to a mass flow from the screening decks 2. Each of the sensors 5 are arranged such that their respective range of measurement lies outside of a ballistic trajectory A of the sorted material when it leaves the discharge 6 of the screening deck but still within an area in which at least a part of a detached screening module 3 (or similar) would be present after leaving the discharge of the screening deck 2. This trajectory can be determined by empirical experiments or calculated in advance taking into consideration e.g. the working parameters of the screening device (amplitude; frequency, etc.), the properties of the material to be sorted and the properties of possible foreign objects (e.g. screening modules and liner elements used in the screening equipment). However, in order to avoid that any foreign objects in the mass flow are missed, it is also possible, and possibly preferable, to arrange the sensors 5 such that their range of measurement has a certain overlap with the ballistic trajectory A of the screened material. Therefore, the control unit 7 is preferably arranged to differentiate between signals from the sensors 5 resulting from the screened material and signals from the sensors 5 resulting from a foreign object, such as a dislodged screening module or liner element, preferably by applying predefined threshold values. The threshold values can for example be based on material type or size of the material to be screened. This way, since the screening modules 3 are made of a different material and/or is larger in size than the material that is screened in the screening device 1, they can be detected by the detection system 4 when passing the area covered by the sensors 5. As soon as a screening module 3 or similar is detected, the screening device 1 can be stopped for maintenance. The threshold may also be based on the time which an object is present in the range of the sensor 5. Since a liner element or a screening module 3 normally will be of greater size and made from different materials than the sorted material, it will be present in the range of the sensor/s for a longer time, or at least under a different length of time than particles of the sorted material. Therefore, it is possible to base threshold values on the time an object is present in the range of the sensor/s. The control 7 unit may also, for example, be programmed to have different threshold values which thereafter may be used to determine whether a foreign object exists in the mass flow or not. The threshold levels may also or alternatively be based on the size or on the material of the objects present. In other words, the control unit 7 may be arranged to differentiate between signals from the sensor 5 resulting from the material to be screened and signals from the sensor resulting from a foreign object, such as a dislodged screening module 3 or liner element, by applying predefined threshold values. Different materials will reflect acoustic waves differently and objects of different size will also reflect acoustic waves differently. Hence, it is possible to differentiate between e.g. a screening module made from e.g. rubber covered metal and gravel particles to be screened. Some or all of the sensors 5 according to the invention are capable of determining the area of the object which is detected and since e.g. a screening module in most cases will have a larger surface than the particles of the material to be screened, it will be possible to determine presence of a foreign object based on the area of the object that is detected by the senor/s. These threshold values can be used alone or in combination with one or more of the others. It is also possible to arrange the control unit such that it takes readings of a plurality of sensors 5 into consideration. For example, detection of foreign objects made by two or more sensors 5 is most likely more reliable than a reading made by a single sensor 5.

Figure 3:
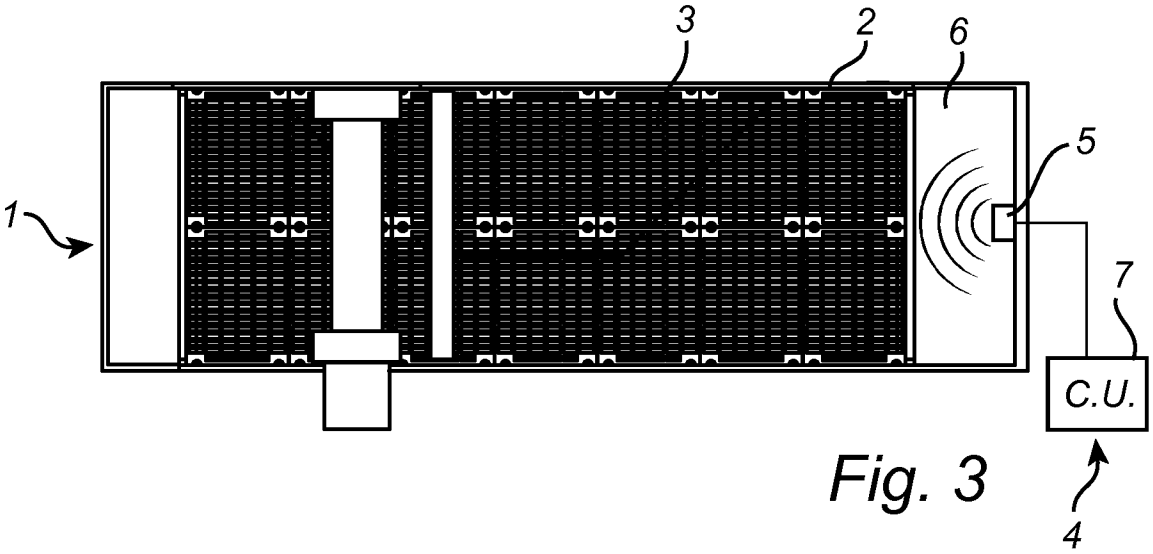
FIG. 3 is a top view of the screening device equipped with the detection system according to another exemplary embodiment of the invention.

FIG. 3 illustrates the screening device 1 equipped with the detection system 4 according to another exemplary embodiment of the invention. In this embodiment, each sensor 5 is attached to the side wall opposed to the discharge 6 of the screening deck. Here, the sensors 5 transmit signals in a direction generally parallel with the mass flow from the screening decks 2, instead of generally perpendicular to the mass from the screening decks 2.

Figure 2:
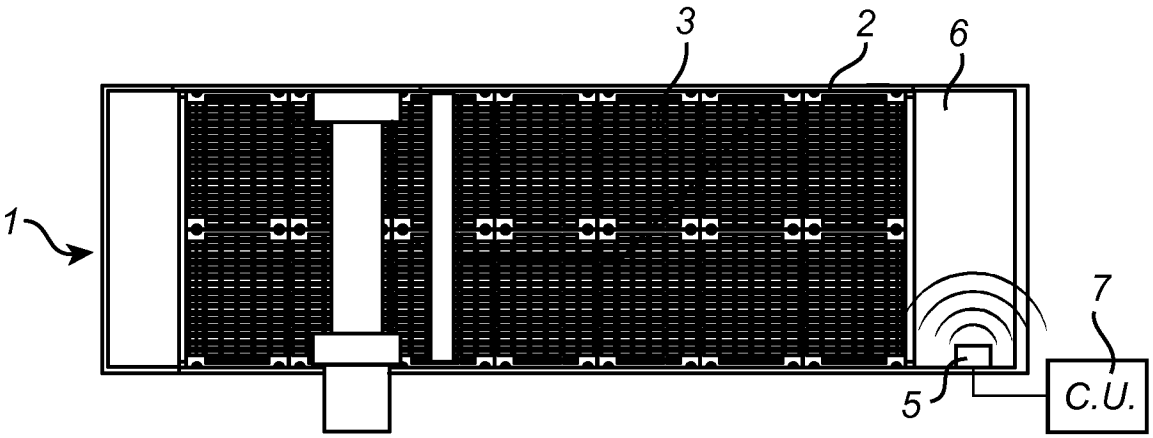
FIG. 2 is a top view of the screening device in FIGS. 1*a* and 1*b*.

FIG. 4 illustrates a detail of the system according to the invention. Here it is disclosed in more detail how a flow of material leaves the inclined screening deck 2 and as can be seen a screening module 3 has detached from the screening deck 2 and follows the flow of material leaving the screening deck 2. Due to its size, the screening module 3 will at least in part and at least during a certain amount of time protrude from the flow of material flowing along trajectory A. This protrusion of the screening module 3 can be detected by sensor 5 as has been disclosed above. In FIG. 4, the sensor is arranged as shown in FIGS. 1*a*, 1*b* and 2, i.e. transmitting in a direction generally perpendicular to the direction of the mass flow.

The skilled person realizes that a number of modifications of the embodiments described herein are possible without departing from the scope of the invention, which is defined in the appended claims. For instance, the sensor can be arranged on a support structure independent from the screening device. In another embodiment, the sensor is attached to a side wall of the screening device. An ultrasound sensor can be a piezoelectric or capacitive transducer. In addition to ultrasound sensors, suitable sensors include laser, radar, sonar, lidar. It would also be possible to use photogrammetry for this purpose. Photogrammetry is suitable for applications where it is necessary to detect and differentiate between elements having different properties (size, color, speed, etc.), which makes it useful in the current invention. A combination of different types of sensors is also conceivable. The skilled person also realizes that even though only two conveyer belts are indicated in the figures, it is of course possible, and often preferable, to have further conveyer belts, containers, chutes or similar. In FIGS. 1*a* and 1*b*, for example, two further conveyer belts (or chutes or containers) would be preferable in order to keep separated the flow from the respective screening decks from each other. It would also be possible to arrange one or more sensors 5 below the lowermost screening deck to be able to detect foreign objects that falls through the deck. Normally, screening modules and other foreign objects will be transported together with the screened material along the screening deck but the possibility that may fall downwardly cannot be excluded and thus one or more sensors at that position may be advantageous. Even though the system is indicated as comprising three sensors, it is not a requirement to be able to perform the invention. One, two or more than three sensors are of course also conceivable.

The invention claimed is:

1. A detection system for use in a screening device for screening material, the screening device including at least one screening deck including a plurality of screening modules which together define a screening surface of the screening device, the system comprising:

an ultrasound sensor arranged at or near the least one screening deck of the screening device, the ultrasound sensor having a sensing range such that the ultrasound sensor is operable to detect objects leaving the at least one screening deck that are in the sensing range, wherein the ultrasound sensor is operable to generate a sensing signal when objects are in the sensing range; and a control unit in communication with the ultrasound sensor to receive the sensing signal from the ultrasound sensor based on the detection of objects leaving the at least one screening deck that are in the sensing range, wherein the control unit is operable to determine an amount of time the sensing signal is received from the ultrasound sensor and apply one or more predefined threshold values that are based on a time an object is present in the sensing range of the ultrasound sensor to differentiate between signals resulting from the material to be screened and signals resulting from a foreign object.

2. The detection system according to claim 1, wherein the ultrasound sensor is arranged at or near a discharge end of the at least one screening deck, or at or near a funnel arranged downstream of the at least one screening deck.

3. The detection system according to claim 1, wherein the ultrasound sensor is arranged to detect objects present outside a predefined area adjacent to a discharge end of the at least one screening deck.

4. The detection system according to claim 3, wherein the predefined area is at least in part defined by a ballistic trajectory.

5. The detection system according to claim 4, wherein the ballistic trajectory has a starting point at or near the discharge end of the at least one screening deck.

6. The detection system according to claim 1, wherein the ultrasound sensor is a rangefinder.

7. The detection system according to claim 1, wherein the ultrasound sensor is arranged on a structure which is independent of the screening device.

8. The detection system according to claim 1, wherein the control unit is configured to operate the screening device based on information from the ultrasound sensor.

9. A detection system for use in a screening device for screening material, which screening device includes at least one screening deck including a plurality of screening modules which together define a screening surface, the detection system comprising:

an ultrasound sensor arranged at or near a discharge end of the at least one screening deck of the screening device, wherein the ultrasound sensor is arranged such that it can detect objects leaving the discharge end of the at least one screening deck, and wherein the ultrasound sensor is arranged to detect objects present outside a predefined area adjacent to the discharge end of the at least one screening deck, wherein the material being screened leaves the screening deck through the predefined area.

10. The detection system according to claim 9, wherein the predefined area is at least in part defined by a ballistic trajectory.

11. The detection system according to claim 10, wherein the ballistic trajectory has a starting point at or near the discharge end of the at least one screening deck.

12. The detection system according to claim 9, wherein the ultrasound sensor is a rangefinder.

13. The detection system according to claim 9, wherein the ultrasound sensor is arranged on a structure which is independent of the screening device.

14. The detection system according to claim 9, wherein the detection system further comprises a control unit which is connected to the ultrasound sensor.

15. The detection system according to claim 14, wherein the control unit is configured to operate the screening device based on on a sensing signal from the ultrasound sensor.

16. The detection system according to claim 14, wherein the control unit is configured to differentiate between signals from the ultrasound sensor resulting from the material to be screened and signals from the ultrasound sensor resulting from a foreign object.

17. The detection system according to claim 16, wherein the control unit is arranged to differentiate between signals from the ultrasound sensor resulting from the material to be screened and signals from the ultrasound sensor resulting from a foreign object, by applying one or more predefined threshold values.

18. The detection system according to claim 17, wherein the one or more predefined threshold values is based on a time an object is present in the range of the ultrasound sensor.

19. The use of the detection system according to claim 1, in a screening device comprising one or more screening decks, in order to detect foreign objects present in a mass flow of screened material.

20. The use of the detection system according to claim 9, in a screening device comprising one or more screening decks, in order to detect foreign objects present in a mass flow of screened material.

21. The detection system according to claim 1, wherein the foreign object is one of the plurality of screening modules, or a liner element, which has become detached during use.

22. The detection system according to claim 21, wherein the foreign object is one of the plurality of screening modules, which has become detached during use.

* * * * *